United States Patent [19]

Italiano

[11] Patent Number: 4,953,512

[45] Date of Patent: Sep. 4, 1990

[54] METHANE CATALYTIC COMBUSTION BOILER FOR OBTAINING HOT WATER FOR HOUSE-HOLD AND INDUSTRIAL USES

[75] Inventor: Pietro Italiano, Cernusco Sul Naviglio, Italy

[73] Assignee: GRIV S.r.l., Milan

[21] Appl. No.: 386,195

[22] Filed: Jul. 28, 1989

[30] Foreign Application Priority Data

Jul. 29, 1988 [IT] Italy ..... 21568 A/88

[51] Int. Cl.[5] ..... B09B 3/00; F22B 1/00

[52] U.S. Cl. ..... 122/4 D; 122/14; 122/18; 122/367.4; 431/170

[58] Field of Search ..... 431/7, 170; 122/4 D, 122/14, 18, 367 PF

[56] References Cited

U.S. PATENT DOCUMENTS

| | | | |
|---|---|---|---|
| 737,279 | 8/1903 | Ruby | 122/367 PF |
| 1,720,757 | 7/1929 | Blanchard | 431/170 |
| 2,082,338 | 6/1937 | Hays | 122/367 PF |
| 3,898,043 | 8/1975 | Schutte et al. | 122/4 D |
| 4,009,121 | 2/1977 | Luckenbach | 122/4 D |
| 4,089,303 | 5/1978 | Brulfert | 122/4 D |
| 4,455,969 | 6/1984 | Barker | 122/4 D |
| 4,555,993 | 12/1985 | Gallaro | 122/4 D |
| 4,725,288 | 2/1988 | Bougard | 122/4 D |
| 4,836,117 | 6/1989 | Teller et al. | 110/342 |

*Primary Examiner*—Henry A. Bennet
*Assistant Examiner*—Denise L. Ferensic
*Attorney, Agent, or Firm*—Birch, Stewart, Kolasch & Birch

[57] ABSTRACT

A methane catalytic combustion boiler for obtaining hot water for household and industrial uses, such as room heating, sanitary services, heat transfer in industrial processes is described. The boiler includes a container for the combustion catalyst, which consists of pure or supported metal oxides, a heat exchanger between the combustion gases and the water to be heated, a system for starting the methane combustion and a system for controlling the combustion.

6 Claims, 2 Drawing Sheets

METHANE CATALYTIC COMBUSTION BOILER FOR OBTAINING HOT WATER FOR HOUSE-HOLD AND INDUSTRIAL USES

FIELD OF THE INVENTION

The present invention relates to a boiler for obtaining hot water for household and industrial uses by combustion of methane on a catalytic bed.

BACKGROUND ART

The availability and cheapness of methane have brought about a demand by the consumers of plants employing methane both for room heating and for sanitary and industrial uses.

The boilers now available on the market present many shortcomings. These originate particularly from the fact that the temperature of free flame methane fuel gases may reach up to 1300°-1950° C. This causes serious problems in connection with the quality of the construction materials, the thermal exchange efficiency, the fuel consumption, the production of obnoxious gases and the safety.

SUMMARY OF THE INVENTION

The above mentioned problems are solved with full satisfaction by the catalytic boiler for methane combustion of the present invention.

We have found in fact that it is possible to obtain the complete combustion of methane at decidedly lower temperature than in the case of the free flame combustion, if the methane-air mixture is contacted with a catalyst consisting of pure or supported metal oxides. The oxidation state of said oxides varies depending on the temperature and on the excess or defect of oxygen, and, because of this, an efficient combustion results in different feeding conditions of the mixture.

The boiler comprises a container for the catalyst, a catalyst, means for heat exchange between the combustion gases and the water to be heated, means for starting the methane combustion and a system for controlling the combustion.

Said boiler is useful for the production of hot water for household and commercial uses.

DETAILED DESCRIPTION OF THE INVENTION

Figure 1:
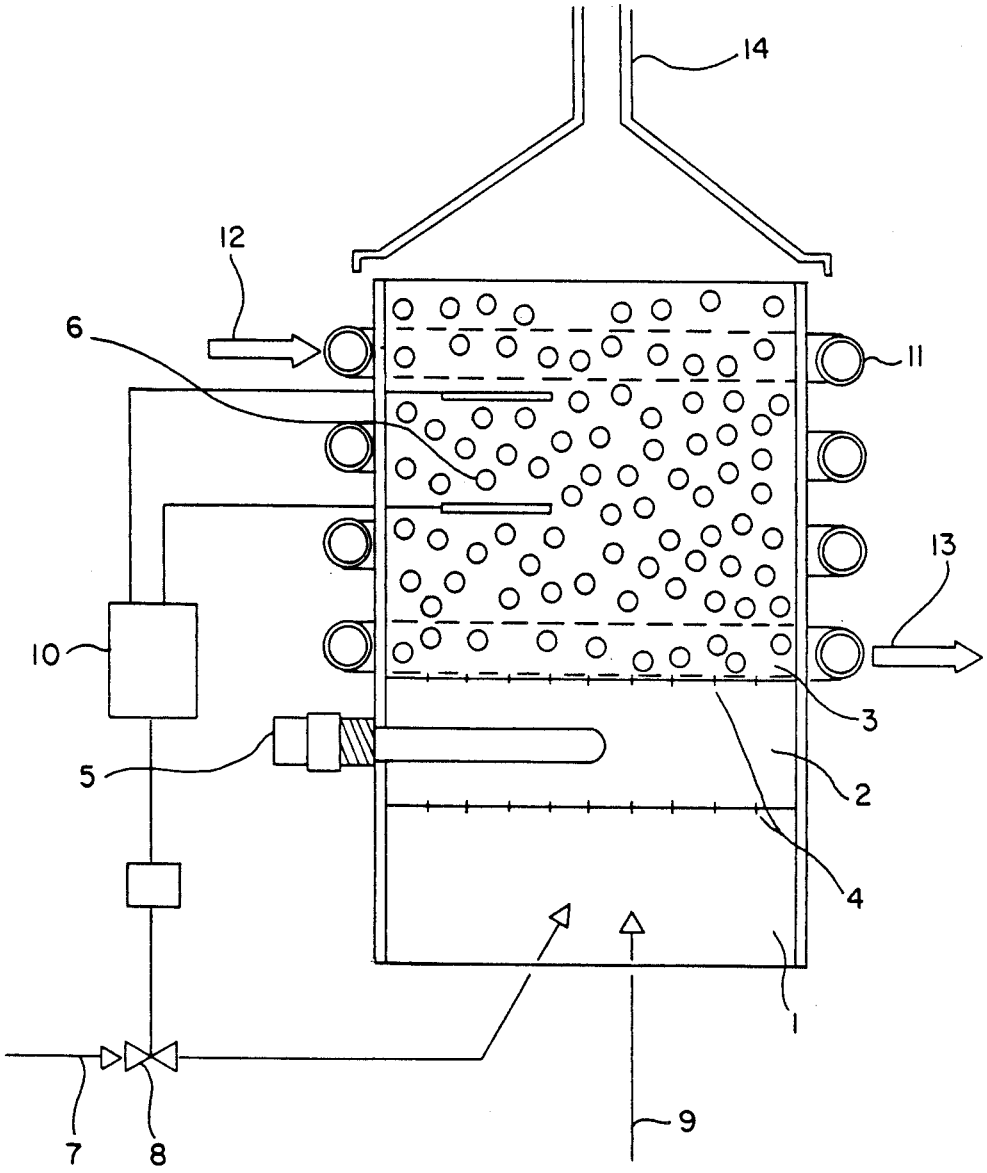
Figure 2:
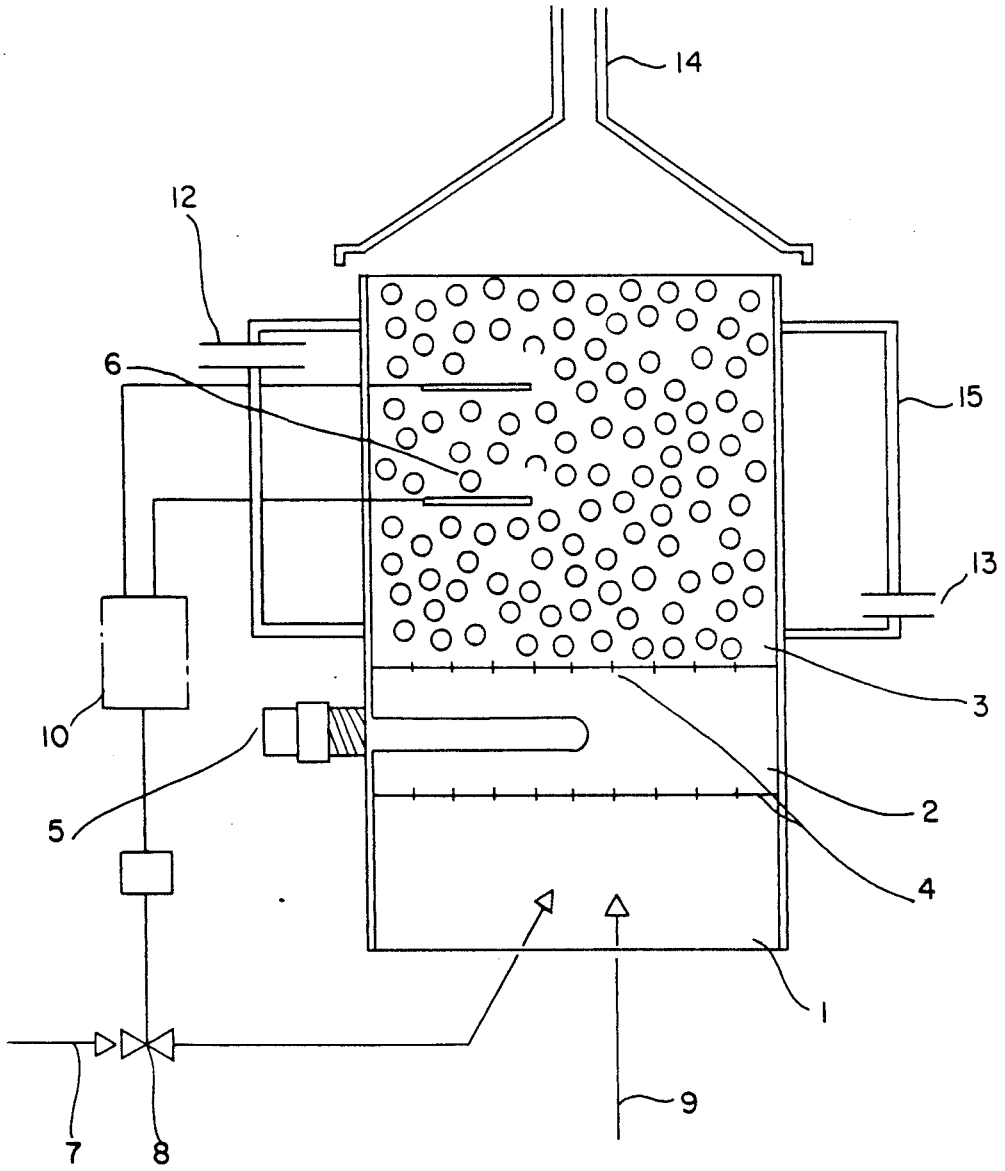

The characteristics and advantages of the methane catalytic combustion boiler for obtaining hot water for household and industrial purposes according to the invention will be put in better evidence by the following detailed description and by the enclosed FIGS. 1 and 2, which are reported for illustrative, but not limitative, purposes.

The catalysts employed in the boiler according to the present invention consist of metal oxides, pure or supported, single, mixed or admixed, of metals selected from the group consisting of Cr, Mn, Fe, Ca, Ni, Cu, Zn, Sn.

An example of a catalyst particularly suited to the low temperature combustion of methane (ignition at 270°-300° C.) is a mixture of Cu and Cr oxides in various oxidation states. The catalyst may be in pellets, tablets, or spheres of 1 to 20 mm diameter. These dimensions allow the gases to pass through the catalytic bed with only a moderate pressure drop, thus avoiding the need of pumps or other devices to facilitate the gas flux.

Said catalysts have a specific surface area comprised between 1 and 200 $m^2/g$.

These catalysts are very active, allowing very high flow capacities, typically comprised between 2,000 and 100,000 volumes of gas per catalyst volume per hour. The catalyst is placed in a layer of a thickness variable according to the power of the boiler.

The heat exchange between the catalytic bed, the combustion gases and the water to be heated is obtained by means of a metal heat-sink supported on the outer surface of the catalyst container. In the catalyst container, a direct contact between heat-sink and catalyst, which would impair the reaction, is avoided. The system is made out of a metal with good heat transfer properties, such as copper, in order to obtain an efficient heat exchange and a good uniformity of the thermal profile in the catalytic bed.

We have found that if the heat exchange takes place with the exchanger directly included in the catalytic mass, the temperature falls at the contact surface between the catalytic grains and the exchanger are such that the temperature of the system falls below the ignition temperature, thus leading progressively the combustion to stop.

With the catalysts according to the present invention, the ignition temperatures of the methane-air mixture are between 200° and 400° C., while the catalytic bed temperature during the normal working of the boiler is comprised between 350° and 750° C.

Such temperature levels allow the use of common construction materials. At a reaction temperature lower than 750° C. furthermore the formation of carbon monoxide and nitrogen oxides is avoided, while they are always present when burning methane in a free flame at temperature higher than 1,000° C.

The catalyst's property of varying its oxidation state depending on the thermal profile leads also to the reduction of nitrogen oxides which may be present to elemental nitrogen.

A further characteristic of the boilers according to the present invention is that they comprise a reaction control system simply consisting of one or more thermocouples sunk in the catalyst bed, which signalize, to a system blocking the methane feed, temperature falls below the ignition limits which may take place.

This control system is an additional advantage of the present invention, in that it avoids the inconvenience of fooling of the photocells used for the control of the conventional burners.

The system blocking the methane feed also controls the electrical start of the gas ignition each time the boiler is started.

It is possible, without departing from the essence of the invention, to recycle combustion gases, pre-heating gas and water feeds, thus recovering also such heat dispersions. The methane-air admixture is made according to a particular embodiment of the invention prior to admitting the gases in the catalyst container; it is, however, possible to introduce the two gases separately in a chamber situated below the catalyst container and comprising the ignition system.

According to a typical embodiment of the present invention, the combustion gases, after pre-heating the feeds, are particularly recycled to the combustion together with the air and methane feed. Thus a further control of the desired temperature level is provided.

The amount of air feed is adjusted at any rate so as to have an at least stoichiometric ratio between oxygen and methane.

BRIEF DESCRIPTION OF THE PREFERRED EMBODIMENT

FIGS. 1 and 2 schematically show an embodiment of the boiler according to the present invention.

DESCRIPTION OF THE PREFERRED EMBODIMENTS

Referring to the reference numerals in the figures, the boiler consists essentially of three superimposed cylindrical chambers, 1, 2 and 3, respectively.

Chamber 1 is connected with chamber 2 through a porous wall 4, and chamber 2 with chamber 3 through a porous wall 4. Chamber 2 contains an electrical ignition system 5, which starts the methane combustion. Chamber 3 contains a catalyst 6. Chamber 1 has the purpose of pre-mixing the gases fed; the combustion starts in chamber 2 whereas chamber 3 has the function of completing the combustion and the heat exchange. Methane is fed through a pipe 7, through a valve 8, while air is fed through a pipe 9.

The pre-mixing chamber 1 should be constructed so as to facilitate a homogeneous mixing of the gases.

Once the combustion is started, the temperature in the catalytic bed remains higher than the ignition temperature, due to the reaction heat, and the electrical ignition system is automatically disconnected, to be re-inserted at each new start of the boiler.

The combustion is controlled by means of thermocouples immersed in the catalyst and which signalize to a system 10, which blocks the methane feed, if the temperature falls below the reaction ignition value.

The blocking system operates through the valve 8. The heat exchange for obtaining hot water is performed by means of a metallic dissipator (heat-sink) supported on the outer surface of the catalyst container. Said dissipator may for instance be in the form of a coil 11, or of a jacket 15.

The dissipator is fed with water from a main through a pipe 12, while the hot water proceeds to the use via a pipe 13. The combustion fumes exit through a chimney 14.

EXAMPLE

Experiments on methane combustion in a boiler of the type described were carried out for a long period (7 months), using as catalyst 350 ml of copper chromite of the Harshaw Co. and as heat exchanger a coil consisting of a copper pipe of 4×6 mm diameter wound in five spirals of 50 mm diameter.

Methane was fed at a rate of 60–80 N1/h and air at 690 to 1800 N1/h. Water passed through the coil at the rate of 8 1/h, entering at 20° C. and being collected at the exit at 47°–50° C. The temperature at the center of the catalyst bed was between 514° and 740° C.

Further experiments were carried out in a similar way using various catalyst types in the combustion of methane. Table 1 summarizes the experiments.

TABLE 1

| Catalyst Type | Commercial denomination | Specific surface $m^2/g$ | Ignition Temper. °C. | Temperature in the reactor min °C. | max °C. |
|---|---|---|---|---|---|
| Mn(II,IV)Ox | — | 1 | 530 | 650 | 900 |
| $Fe_2O_3/AL_2O_3$ | — | 37 | 500 | 620 | 840 |
| $Ni/NiO/Al_2O_3$ | Harshaw Ni5124 | 145 | 450 | 600 | 850 |
| $CuO/Cr_2O_3/BaO$ | Cu1107 | 35 | 400 | 500 | 750 |
| $Co_3O_4/Al_2O_3$ | | 110 | 400 | 500 | 800 |
| $NiO/Co_3O_7$ | Ni6458 | 180 | 400 | 500 | 850 |
| $CuO/Cr_2O_3$ | Cu1234 | | 270 | 350 | 700 |

In all cases the methane combustion was complete. No carbon monoxide or nitrogen oxides were detected at the stack in most of the experiments, while traces were present in some.

By comparison, the analysis of the combustion gases of a conventional methane boiler gave a CO content of 60–75 ppm and a nitrogen oxide content of 60–66 ppm.

I claim:

1. Methane catalytic combustion boiler for obtaining hot water for household and industrial uses by catalytic complete combustion of the methane contained in an air/methane mixture fed to it, said mixture containing oxygen in an amount corresponding at least to the stoichiometric amount necessary for said complete combustion of methane, comprising a catalyst container containing a non-fluidized bed of a catalyst consisting of a metal oxide or a mixture of metal oxides selected from the group of the oxides of Cr, Mn, Fe, Co, Ni, Cu, Sn and Zn maintained at a temperature of less than 750° C.;

a metal heat-sink means supported on the outer surface of said catalyst container for heat exchange between the combustion gases and the water to be heated;

an electrical ignition system placed near the inlet of said air/methane mixture for starting the methane combustion; and one or more thermocouple means sunk in the catalyst bed which signal a system blocking the methane feed if the temperature falls below the ignition limits of said air/methane mixture.

2. Boiler according to claim 1, wherein said catalyst consists of copper chromite.

3. Boiler according to claim 1, wherein said catalyst is in the form of pellets, tablets or spheres of 1–20 mm diameter.

4. Boiler according to claim 1, wherein said catalyst has a specific surface comprised between 1 and 200 sq.m/g.

5. Boiler according to claim 1, wherein said air/methane mixture is passed through said catalyst bed at a specific rate comprised between 2,000 and 100,000 volumes per volume of catalyst and per hour.

6. Boiler according to claim 1, wherein the temperature of said bed of catalyst during the normal working of the boiler is between 350° and 750° C.

* * * * *